US005610648A

United States Patent [19]

Sims et al.

[11] Patent Number: 5,610,648

[45] Date of Patent: Mar. 11, 1997

[54] THERMAL PRINTING DEVICE

[75] Inventors: Charles R. Sims; Michael A. Beadman, both of Herts, United Kingdom

[73] Assignee: Esselte N.V., St. Niklaas, Belgium

[21] Appl. No.: 94,678

[22] Filed: Jul. 20, 1993

[30] Foreign Application Priority Data

Jul. 24, 1992 [GB] United Kingdom ..... 9215782

[51] Int. Cl.[6] ..... B41J 2/325

[52] U.S. Cl. ..... 347/174; 347/172; 347/176

[58] Field of Search ..... 346/76 PH; 400/120, 400/120.02, 120.04; 347/172, 174, 176

[56] References Cited

U.S. PATENT DOCUMENTS 4,778,290 10/1988 Costa et al. .
5,111,216 5/1992 Richardson et al. ..... 346/76 PH
5,183,333 2/1993 Minowa ..... 400/605

FOREIGN PATENT DOCUMENTS 0114975 11/1983 European Pat. Off. ..... B41J 3/20
0184234 10/1985 European Pat. Off. ..... B41J 35/18
0267890A2 11/1987 European Pat. Off. .
0322918B1 12/1988 European Pat. Off. .
58-4102 1/1983 Japan ..... B41J 35/18
61-65084 3/1986 Japan ..... B41J 35/18
2250479 11/1991 United Kingdom ..... B41J 33/22
2253812 9/1992 United Kingdom .
WO91/12969 2/1990 WIPO ..... B41J 29/42

*Primary Examiner*—Huan H. Tran
*Attorney, Agent, or Firm*—Pennie & Edmonds

[57] ABSTRACT

A thermal printing device is capable of printing labels in a plurality of colours. When printing in a particular colour has been completed, further movement of image receiving tape is prevented so that an image transfer ribbon of a different colour can be exchanged for the first image transfer ribbon. In this way, multiple colour labels can be printed in a simple and efficient manner.

14 Claims, 3 Drawing Sheets

THERMAL PRINTING DEVICE

FIELD OF THE INVENTION

This invention relates to a thermal printing device.

BACKGROUND TO THE INVENTION

Thermal printing devices of the general type with which the present invention is concerned are known. They operate with a supply of tape arranged to receive an image and a means for transferring an image onto the tape. In one known device, a tape holding case holds a supply of image receiving tape and a supply of an image transfer ribbon, the image receiving tape and the transfer ribbon being passed in overlap through a printing zone of the printing device. At the print zone, a thermal print head cooperates with a platen to transfer an image from the transfer ribbon to the tape. A printing device operating with a tape holding case of this type is described for example in EP-A-0267890 (Varitronics, Inc.). Other printing devices have been made in which letters are transferred to an image receiving tape by a dry lettering or dry film impression process. In all of these printing devices, the construction of the image receiving tape is substantially the same. That is, it comprises an upper layer for receiving an image which is secured to a releaseable backing layer by a layer of adhesive.

Once an image or message has been printed on the tape, that portion of the tape is cut off to enable it to be used as a label. The releaseable backing layer is removed from the upper layer to enable the upper layer to be secured to a surface by means of the adhesive layer.

In another known printing device, described in EP-A-0322918 (Brother Kogyo K. K.), a tape holding case houses a supply of a transparent image receiving tape and a supply of an image transfer ribbon. The tape holding case also houses a supply of backing tape which comprises a carrier layer having an adhesive layer on its underside to which is secured a releaseable backing sheet and an adhesive layer on its upper side which can be secured to the image receiving tape after an image has been printed thereon. In this device, the image is printed onto the image receiving tape as a mirror image which, when viewed through the image receiving tape, is the correct way round. With this device, the print is protected when the label is used.

In all of these devices, the colour of the label and the colour of the print are predetermined by the contents of the tape holding case. By the colour of the label reference is made to the upper layer of the image receiving tape of the apparatus described in EP-A-0267890 and to the carrier layer of the device described with reference to EP-0322918. The colour of the print is determined by the colour of the image transfer ribbon. The labels can thus only be printed with ink of a single colour.

SUMMARY OF THE INVENTION

According to the present invention there is provided a thermal printing device having means for receiving a tape holding case housing a supply of an image transfer ribbon capable of printing an image of a particular colour, means for moving an image receiving tape through a printing zone in overlap with said image transfer ribbon so that an image can be transferred from the image transfer ribbon onto the image receiving tape; means for determining when a particular portion of a message to be printed onto the image receiving tape has been printed and for preventing further movement of the image receiving tape while image transfer ribbon of a different colour is located in overlap with said image receiving tape and means for restarting movement of said image receiving tape so as to print a next portion of said message in said different colour.

In one embodiment, the means for preventing further movement of the image receiving tape also causes a signal to be given to a user either audibly or visually to indicate that they should now swap the tape holding case containing the image transfer ribbon of said particular colour for a tape holding case containing an image transfer ribbon of a different colour. Only when the second tape holding case has been inserted does printing resume. In an alternative embodiment, the replacement of the tape holding case can be carried out automatically by the printing device.

In a further embodiment, the image transfer ribbons can be joined one to another side by side and would sit in a common tape holding case with means for altering the position of the ribbon to present one colour or another to the print zone.

Preferably, each message to be contained on a label is formulated as a plurality of pages and during such formulation a particular colour is designated for each page. A microprocessor of the printing device stores not only data concerning the characters to be printed on each page but also data identifying the end of a page. During printing, the end of page data indicates to the microprocessor that it should provide the signal to prevent further printing to enable the present tape holding case to be replaced by one containing ink ribbon of a different colour.

In this way, multicolour labels can be printed in a simple and efficient manner.

According to another aspect of the invention there is provided a method of printing a label in more than one colour comprising: formulating a message to be printed as a plurality of pages; for each page storing data relating to characters to be printed, end-of-page data denoting the end of a page and colour data defining the colour of print; printing a first one of said pages using image transfer ribbon of a first colour; preventing further printing on detection of end-of-page data; exchanging said image transfer ribbon for image transfer ribbon of a different colour; and printing a next one of said pages.

For a better understanding of the present invention, and to show how the same may be carried into effect, reference will now be made by way of example to the accompanying drawings.

DESCRIPTION OF THE PREFERRED EMBODIMENT

Figure 1:
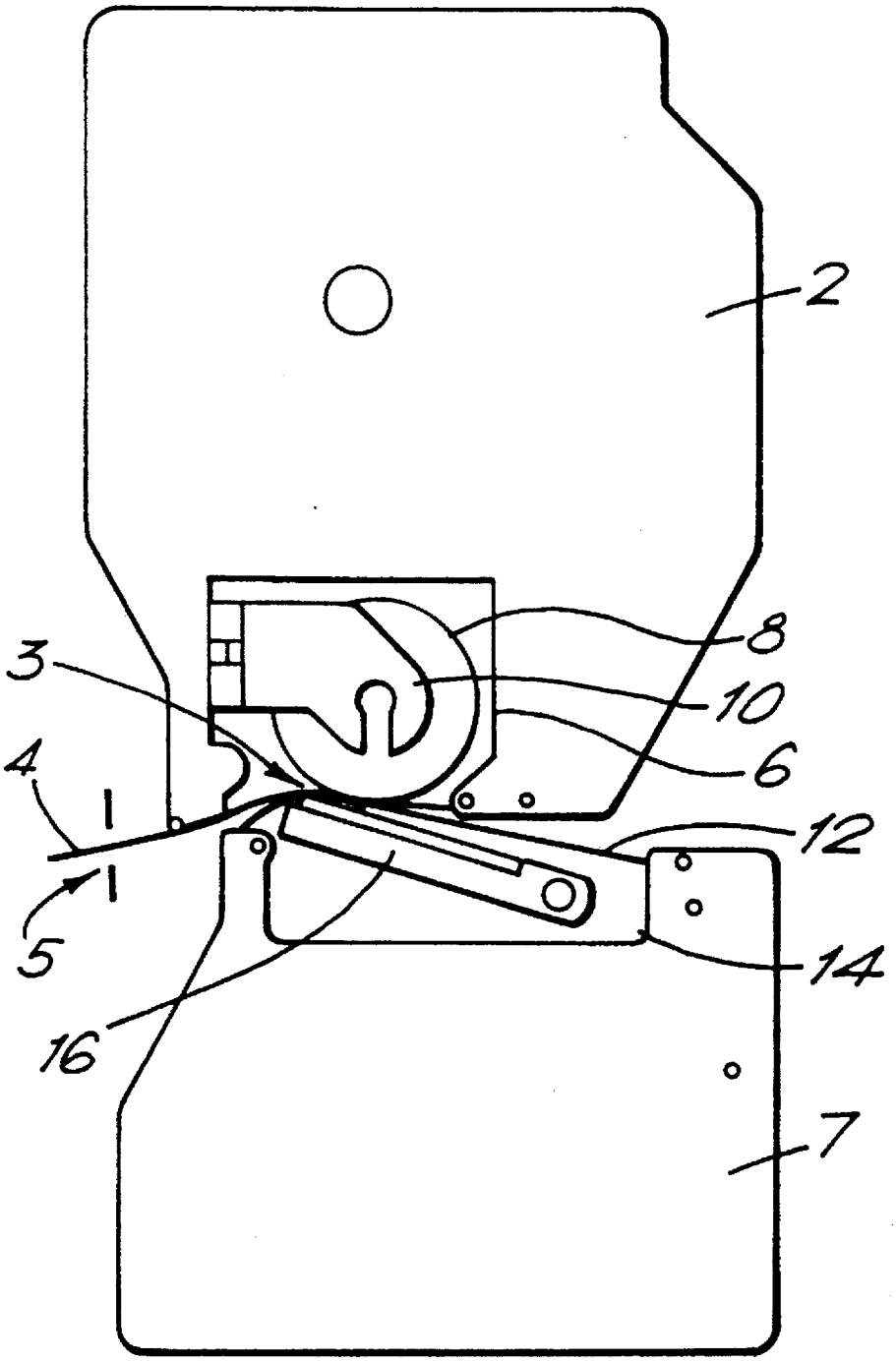
FIG. 1 is a plan view showing two cassettes inserted in a printing device.

FIG. 1 shows in plan view two cassettes arranged in a printing device. The upper cassette 2 contains a supply of image receiving tape which passes through a print zone 3 of the printer to an outlet 5 of the printer. The image receiving tape 34 comprises an upper layer for receiving a printed image on one of its surfaces and having its other surface coated with an adhesive layer to which is secured a releaseable backing layer. The cassette 2 has a recess 6 for accommodating a platen 8 of the printer. The platen 8 is mounted for rotation within a cage moulding 10.

The lower cassette 4 contains a thermal transfer ribbon which extends from a supply spool to a take-up spool within the cassette 4. The thermal transfer ribbon 12 extends through the print zone 3 in overlap with the image receiving tape 34. The cassette 4 has a recess 14 for receiving a print head 16 of the printer. The print head 16 is movable between an operative position, shown in FIG. 1, in which it is in contact with the platen and holds the thermal transfer ribbon 12 and the image receiving tape 34 in overlap between the print head and the platen and an inoperative position in which it is moved away from the platen to release the thermal transfer ribbon and image receiving tape. In the operative position, the platen is rotated to cause image receiving tape to be driven past the print head and the print head is controlled to print an image onto the image receiving tape by thermal transfer of ink from the ribbon 12. The print head is a conventional thermal print head having an array of pixels each of which can be thermally activated in accordance with the desired image to be printed.

A stepper motor 7 (FIG. 2) drives the platen 8 in steps so that for each position of the platen a column of print is printed on the image receiving tape 34. The platen 8 drives the image receiving tape through the print zone under the action of its own rotation. The rotation of the platen and the energisation of the print head 16 are controlled by a microprocessor as described in more detail hereinafter.

Figure 2:
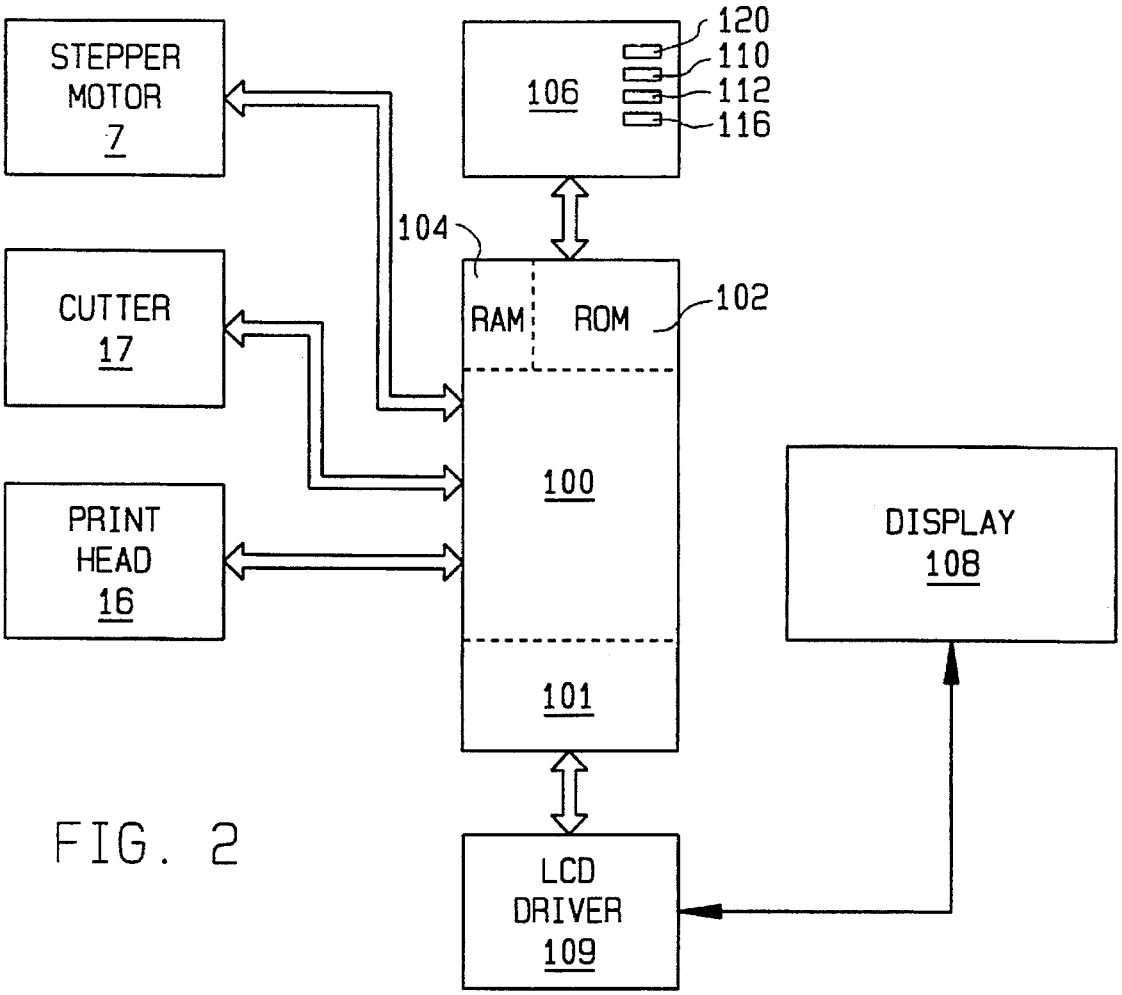
FIG. 2 is a diagrammatic sketch showing the control circuitry for the printing device.

The basic circuitry for controlling the printing device is shown in FIG. 2. There is a microprocessor chip 100 having read only memory (ROM) 102, a microprocessor chip 100, 101 and random access memory capacity indicated diagrammatically by RAM 104. The microprocessor is connected to receive data input to it from a data input device such as a keyboard 106. The microprocessor chip 100 outputs data to drive a display 108 via a display driver chip 109 and also to drive the print head 16 and the stepper motor 7 for controlling the platen 8. The microprocessor chip also controls a cutting mechanism including a cutter 17 to cut off lengths of printed tape.

The operation of the printer will now be described. Data to be printed is typed into the printing device using data input keys on the keyboard 106. The data input keys are designated generally by the block 106 but will in practice comprise a plurality of lettered and numbered keys. As the data is entered into the keyboard 106 it is supplied to the microprocessor 100 which drives the display 108 to display the data as it is entered. To do this, for each character which is entered, the microprocessor calls up a stored version of the character from the ROM 102. As the character is stored in compressed form this font data is stored temporarily in the RAM 104 and is manipulated by the microprocessor chip 100 to generate pixel data to form the character. This pixel data is transmitted in one form to the display 108 and in another form to the print head for printing. Character data is not passed to the print head for printing until a print operation is executed. Firstly, the characters for the label are entered and edited using function keys on the keyboard 106 in conjunction with the display 108.

Figure 3:
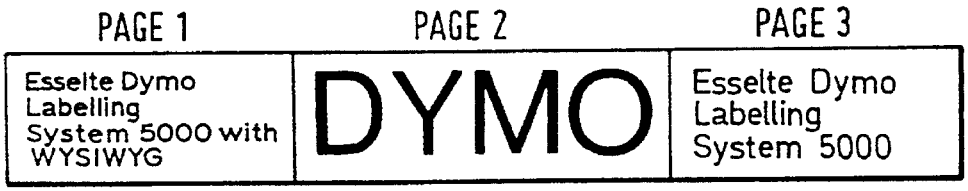
FIG. 3 is a diagram showing a label which can be produced using the printing device.

The label is composed by the user as a plurality of pages. Each page has unique characteristics in terms of its print style, size of font and number of lines to be printed. The pages will be printed side by side with a distance between them corresponding to normal character spacing. Pages can be of differing lengths. Where a page has been composed using the display and a next page is to be printed in a different colour, a colour key 120 can be actuated which signals to the microprocessor that it should store end of page colour change data. Formulation of the label can then continue for the next page until there is to be another colour change when the colour key 120 is again depressed. FIG. 3 shows a label composed of three pages; PAGE 1, PAGE 2 and PAGE 3. The dotted lines in between the pages are there for diagrammatic purposes only and will not appear on the finished label. As an example, PAGES 1 and 3 are to be printed in black and PAGE 2 is to be printed in red.

Once the final form of the label has been worked out, the microprocessor is aware of the pixel data for each page to be printed and has also calculated the overall length of the label. When a print operation is instigated using the print key 112 a column of pixel data is transmitted to the print head which prints this column on the image receiving tape. The stepper motor then moves the image receiving tape forward by one column width and the next column data is transferred to the print head and printed.

This sequence of operations is carried out until a page has been printed. Then, the end of page signal causes the microprocessor to display a symbol on the display 108 which indicates to a user that he should replace the present tape holding case 4 with a different tape holding case having a red ribbon. While this signal is being displayed, the motor driving the platen is stopped so that further movement of the image receiving tape past the print head is prevented. When the user has replaced the tape holding case printing can be resumed by pressing the print key 112. When the red page has been printed, the same sequence of operation occurs, the black tape cassette is reinserted and the third page is printed.

It will be apparent that the signal which indicates to a user that the tape holding case is to be replaced must be given when the printing operations for printing one page have ceased. That is, the part of the tape being printed at this time is not visible to a user so it would not be possible for a user to print multicolour labels in the absence of this signal.

Figure 4:
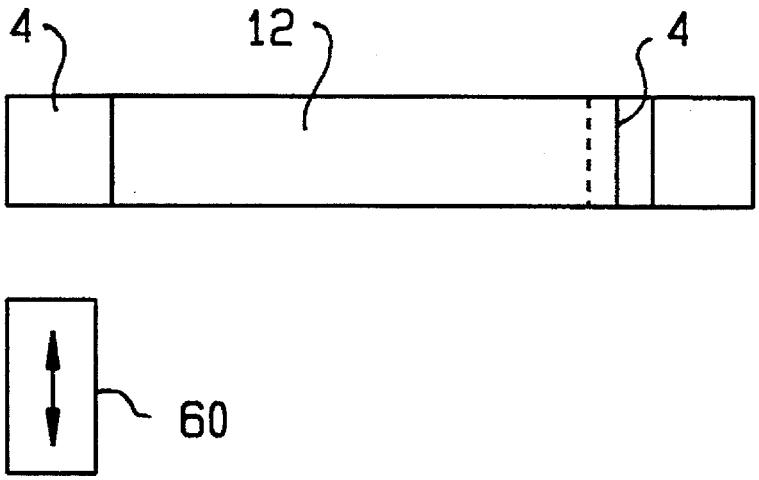
FIG. 4 is a diagram of part of a second embodiment showing a side view of a lower cassette and associated manipulating means.
Figure 5:
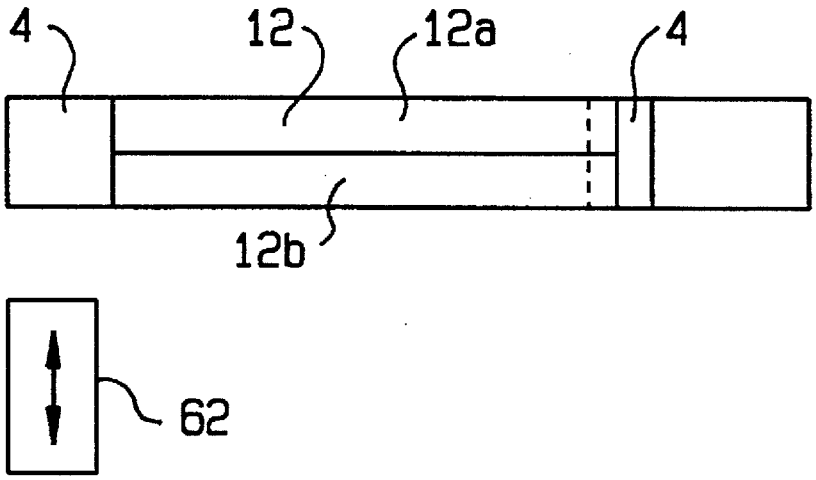
FIG. 5 is a diagram of part of a third embodiment showing a side view of a lower cassette and associated position altering means.

In the described embodiment, the tape holding case is replaced manually by a user. In another embodiment shown in FIG. 4, the printing device could have means 60 for automatically manipulating tape holding cases so as to replace one by another on receipt of the appropriate signal. In a still further embodiment shown in FIG. 5, a tape holding case could hold a ribbon capable of printing in two colours 12*a* and 12*b* depending on the position of the ribbon and the colour change signal could then cause means 62 to alter the position of the tape holding case.

When the complete label has been printed, the stepper motor moves the image receiving tape through a distance corresponding to the distance between the print head and a zone where cutting is implemented. A cutting operation is then executed by the cutter 17 to cut off the printed portion of the tape constituting the label.

It will be apparent that the length of each page can be determined by a user and in particular each page can have only a single character. However, where a label is to have multiple lines with different character sizes in each line it can be advantageous to inhibit operation of the colour change key in between characters to ensure that a situation does not arise where an attempt is made to change the colour midway through printing one character.

What is claimed is:

1. A thermal printing device having means for receiving a tape holding case housing a supply of an image transfer ribbon capable of printing an image in a particular colour; means for receiving a tape holding case housing a supply of an image receiving tape; a print head having a column of printing elements for printing an image on said image receiving tape column by column; means for moving the image receiving tape through a printing zone in overlap with said image transfer ribbon so that a message can be printed onto the image receiving tape, said image receiving tape moving in a printing direction by one column width between the printing of successive columns; means for determining when a particular portion of the message to be printed has been printed in the particular colour on a first portion of the image receiving tape and for preventing further movement of the image receiving tape while an image transfer ribbon of a different colour is located in overlap with said image receiving tape at a second portion thereof spaced from said first portion; and means for restarting movement of said image receiving tape so as to print a next portion of said message in said different colour on said second portion of said image receiving tape.

2. A thermal printing device as claimed in claim 1 wherein the means for preventing further movement of the image receiving tape is also operable to generate a signal to indicate to a user that the image transfer ribbon of said particular colour should be exchanged for an image transfer ribbon of a different colour.

3. A thermal printing device as claimed in claim 2 wherein the signal is audible.

4. A thermal printing device as claimed in claim 2 wherein the signal is visual.

5. A thermal printing device as claimed in claim 1 which further comprises means arranged to automatically exchange the image transfer ribbon of said particular colour for an image transfer ribbon of a different colour.

6. A thermal printing device as claimed in claim 1 wherein the image transfer ribbon tape holding case holds two image transfer ribbons and comprises means for altering the position of the ribbons to present one colour or another to the print zone.

7. A thermal printing device according to claim 1 which comprises means for indicating when a tape holding case containing image transfer ribbon of a particular colour should be exchanged for a tape holding case containing image transfer ribbon of a different colour.

8. A thermal printing device according to claim 1 which comprises a controller operable to store data concerning characters to be printed on each page of a label; data identifying the end of a page; and colour information for each page whereby the end of page data causes the controller to generate a signal to enable the image transfer ribbon of said particular colour to be replaced by an image transfer ribbon of a different colour.

9. A method of printing a label in more than one colour comprising:

formulating a message to be printed as a plurality of pages;

for each page storing data relating to characters to be printed, end-of-page data denoting the end of a page and colour data defining the colour of print;

printing a first one of said pages using image transfer ribbon of a first colour; preventing further printing on detection of end-of-page data;

exchanging said image transfer ribbon for image transfer ribbon of a different colour; and printing a next one of said pages.

10. The method of claim 9 wherein a first one of said pages is printed using an image transfer ribbon of a first colour on a first portion of an image receiving tape; said image transfer ribbon of the different colour is arranged to overlap with said image receiving tape at a second portion thereof spaced from said first portion; and a next one of said pages is printed on a second portion of the image receiving tape.

11. A thermal printing device having a zone for receiving a tape holding case housing a supply of an image transfer ribbon capable of printing an image in a particular colour; a zone for receiving a tape holding case housing a supply of an image receiving tape; a print head having a column of printing elements for printing the image on an image receiving tape column by column; a driver for moving the image receiving tape through a printing zone in overlap with said image transfer ribbon so that a message can be printed onto the image receiving tape, said image receiving tape moving in a printing direction by one column width between the printing of successive columns; and a controller for determining when a particular portion of the message to be printed has been printed in the particular colour on a first portion of the image receiving tape and for preventing further movement of the image receiving tape while an image transfer ribbon of a different colour is located in overlap with said image receiving tape at a second portion thereof spaced from said first portion, and for restarting movement of said image receiving tape so as to print a next portion of said message in said different colour on said second portion of said image receiving tape.

12. A thermal printing device for printing an image on an image receiving tape comprising:

means for receiving a tape holding case housing a supply of image receiving tape on which an image is to be printed;

means for receiving a tape holding case housing a supply of an image transfer ribbon capable of printing a message on said image receiving tape in a particular colour;

means for moving said image receiving tape through a printing zone in overlap with said image transfer ribbon so that an image in said particular colour can be transferred from the image transfer ribbon onto a first portion of the image receiving tape;

printing means for printing an image on said image receiving tape as said image receiving tape and said image transfer ribbon move through the printing zone;

means for determining when a particular portion of a message to be printed onto the image receiving tape has been printed by said printing means in said particular colour and for preventing further movement of the image receiving tape, the means for preventing further movement of the image receiving tape also being operable to generate a signal to indicate to a user that the tape holding case housing said image transfer ribbon of said particular colour should be exchanged for a tape holding case housing a supply of an image transfer ribbon of a different colour, said image transfer ribbon of said different colour being located in overlap with said image transfer tape at a second portion thereof spaced from said first portion; and means for restarting movement of said image receiving tape so that the printing means prints a next portion of said message in said different colour on said second portion of image receiving tape, when said user has exchanged the tape holding case housing a supply of image transfer ribbon of said particular colour for the tape holding case housing a supply of image transfer ribbon of said different colour.

13. In combination, a tape holding case housing a supply of an image transfer ribbon capable of printing an image in a particular color, a tape holding case housing a supply of an image receiving tape and a thermal printing device, said thermal printing device having:

means for receiving said tape holding cases;

a print head having a column of printing elements for printing an image on said image receiving tape column by column;

means for moving the image receiving tape through a printing zone in overlap with said image transfer ribbon so that a message can be printed onto the image receiving tape, said image receiving tape moving in a direction by one column width between the printing of successive columns;

means for determining when a particular portion of the message to be printed has been printed in the particular colour on a first portion of the image receiving tape and for preventing further movement of the image receiving tape while image transfer ribbon of a different colour is located in overlap with said image receiving tape at a second portion thereof spaced from said first portion; and means for restarting movement of said image receiving tape so as to print a next portion of said message in said different colour on said second portion of said image receiving tape.

14. In combination, a tape holding case housing a supply of an image transfer ribbon capable of printing an image in a particular colour, a tape holding case housing a supply of image receiving tape and a thermal printing device, said thermal printing device having;

a zone for receiving said tape holding cases;

a print head having a column of printing elements for printing an image on the image receiving tape column by column;

a driver for moving the image receiving tape through a printing zone in overlap with the image transfer ribbon so that a message can be printed onto the image receiving tape, said image receiving tape moving in a printing direction by one column width between the printing of successive columns; and a controller for determining when a particular portion of the message to be printed has been printed in a particular colour on a first portion of the image receiving tape and for preventing further movement of the image receiving tape while image transfer ribbon of a different colour is located in overlap with said image receiving tape at a second portion thereof spaced from said first portion, and for restarting movement of said image receiving tape so as to print a next portion of said message in said different colour on said second portion of said image receiving tape.

* * * * *